United States Patent [19]

Shay et al.

[11] Patent Number: 4,632,707

[45] Date of Patent: Dec. 30, 1986

[54] PROTECTIVE ATMOSPHERE PROCESS FOR ANNEALING AND/OR HARDENING FERROUS METALS

[75] Inventors: Robert H. Shay, Kutztown; Kerry R. Berger, Lehighton, both of Pa.; Thomas S. Bannos, Cumberland, R.I.

[73] Assignee: Air Products and Chemicals, Inc., Allentown, Pa.

[21] Appl. No.: 721,335

[22] Filed: Apr. 9, 1985

[51] Int. Cl.[4] ..... C21D 1/06; C21D 1/26

[52] U.S. Cl. ..... 148/16.5; 148/16; 148/16.6; 148/20.3

[58] Field of Search ..... 148/16, 16.5, 16.6, 148/20.3

[56] References Cited

U.S. PATENT DOCUMENTS

| | | | |
|---|---|---|---|
| 1,817,407 | 8/1931 | Brower | 148/16.5 |
| 2,056,175 | 10/1936 | Eberie et al. | 148/16.5 |
| 2,161,162 | 6/1939 | Harsch | 148/16.5 |
| 2,329,896 | 9/1943 | Harsch | 148/16.5 |
| 2,673,821 | 3/1954 | Stutzman | 148/16.5 |
| 3,201,290 | 8/1965 | Wyss | 148/16.5 |
| 4,306,918 | 12/1981 | Kaspersma et al. | 148/16.5 |
| 4,415,379 | 11/1983 | Stanescu et al. | 148/16.5 |
| 4,472,209 | 9/1984 | Längerich et al. | 148/16.5 |

*Primary Examiner*—Veronica O'Keefe

[57] ABSTRACT

A process for heating steel under atmosphere for annealing or hardening wherein the atmosphere is generated by injecting a mixture of dimethyl ether and nitrogen into the furnace.

5 Claims, No Drawings

PROTECTIVE ATMOSPHERE PROCESS FOR ANNEALING AND/OR HARDENING FERROUS METALS

TECHNICAL FIELD

This invention pertains to the terhmal metallurgical treating, and in particular to the annealing or hardening of ferrous metals under controlled atmosheres.

BACKGROUND OF THE PRIOR ART

Ferrous metals are defined as the conventional grades of steel being denoted by grade according to the American Iron and Steel Institute (AISI) nomenclature which contain carbon and in particular to the steels conventionally designated as plain carbon, alloy, and alloy tool steels. As these grades of steel are raised to elevated temperature for annealing and/or hardening under an ambient furnace atmosphere containing air, hydrogen, water vapor, carbon dioxide and other chemical compounds, it is well known that the surface of the steel will become reactive. Furthermore, in the presence of water vapor, hydrogen, and carbon dioxide in the furnace atmosphere carbon at the surface of the steel will react and be removed from the surface. Removal of carbon from the surface promotes inhomogeneity of the cross-section due to the change in chemistry and crystallography, thus changing the physical properties such as surface hardness and strength of articles which are subsequently fabricated from the ferrous metal. While no atmosphere process can absolutely assure that carbon will neither be added nor deleted from the surface, all atmosphere processes are utilized to minimize either carbon removal (decarburization) or carbon addition (recarburization) to the surface of metal articles undergoing heating for annealing and/or neutral hardening. Excess decarburization or recarburization necessitates making parts to be oversized and then finishing the parts to file dimensions by expensive finishing operations such as machining, grinding, pickling and the like.

With known methods of generating furnace atmospheres for annealing and/or hardening of ferrous metals, it has been found that the atmospheres are generally inconsistent in composition which may lead to decarburization, recarburization, sooting, oxidation, or a combination of these surface phenomena on the metals being treated.

The foregoing problems have ben somewhat alleviated by using a nitrogen based atmosphere to which hydrocarbons, particularly those of a higher order than methane, are used as the carbon control additives. Sooting is a potential problem and the desirable carbon control agent, carbon monoxide, is only produced from air leaking into the furnace or oxide reduction. Sooting is that phenomena which occurs when there is excess carbon potential in the atmospheron which causes carbon deposition on the surface of the articles being treated. Methanol is an improvement over hydrocarbons, but is a liquid at ambient temperature and must normally be metered and injected as such requirig furnace energy for vaporization and dissociation. In some furnaces, such as bell-type annealing furnaces, it is difficult to inject methanol into the furnace and undesirable levels of the decarburizing and oxidizing agents water vapor and carbon dioxide are formed at temperatures below about 1400° F. (760° C.).

U.S. Pat. No. 4,359,351 discloses and claims a process for annealing ferrous metal articles under an atmosphere produced by a methanol and nitrogen mixture injected into a furnace. The specification of U.S. Pat. No. 4,359,351 is incorporated herein by reference.

Dimethyl ether (DME), $CH_3OCH_3$, is mentioned in U.S. Pat. No. 4,306,918 as a possible carbon control agent for the carburizing process disclosed by patentees.

U.S. Pat. No. 2,673,821 discloses the use of dimethyl ether as a compound suitable for producing a carburizing atmosphere. Patentee recites that dimethyl ether can be diluted with water to prevent sooting which was a common problem with prior art hydrocarbon atmospheres produced by straight hydrocarbons such as propane, natural gas and the like. However, the water content has to be strictly controlled to prevent loss of carbon efficiency during the carburizing process.

U.S. Pat. No. 2,056,175 contains a lengthy discussion on defining a hydrocarbon compound that will produce an atmosphere which will not have the sooting problems found will methane, ethane, propane, butane, or their derivatives in a carburizing process. This work was continued in regard to carburizing processes and further defined in U.S. Pat. Nos. 2,161,162 and 2,329,896.

U.S. Pat. No. 3,201,290 discloses and claims methods of controlling drip feed carburizing furnaces wherein fluids such as alcohols can be used to produce as carburizing atmosphere.

Lastly, U.S. Pat. No. 1,817,407 discloses process for carburizing using a water vapor-hydrocarbon generated atmosphere.

BRIEF SUMMARY OF THE INVENTION

It has been found that when ferrous metal articles are to be heated for annealing or hardening wherein the furnace is maintained at a temperature of between 1200° F. (649° C.) and 1650° F. (899° C.) in order to minimize surfce decarburization and to prevent recarburization of the surface of the articles being treated, an atmosphere produced by injected a mixture of between 0.1 and about 5% (vol.) dimethyl ether balance nitrogen into the furnace is effective.

Furnace atmospheres generated from dissociation of dimethyl ether and a nitrogen carrier gas minimize or eliminate soot formation in the furnace and on the parts being treated while minimizing surface decarburization and eliminating the tendency for the surface of the part being treated to recarburize.

DETAILED DESCRIPTION OF THE INVENTION

Up until the development and application of nitrogen based atmosphere for utilization during the heating of ferrous metal articles for neutral hardening, conventional endothermic generators were used to produce furnace atmospheres in an attempt to prevent the articles being heated from becoming decarburized. In a conventional endothermic (endo) process, a carrier gas mixture is obtained by catalytic partial oxidation of hydrocarbons (e.g., natural gas) resulting in a mixture which consists mainly of 20% carbon monoxide, 40% hydrogen, and 40% nitrogen. Hydrocarbons (e.g., excess natural gas) are usually added to provide the required carbon if the atmosphere is to be used for carburizing. The carbon potential which determines the degree of carburization is controlled by monitoring either the carbon dioxide or the water vapor concentration in the furnace gas. Theoretically, at low carbon potential the furnace atmosphere should be neutral which means that it should be neither carburizing nor decarburizing. However, hydrocarbon based systems can be difficult to control without causing sooting and/or providing a neutral atmosphere.

Another conventional process of producing a protective atmosphere is by the partial or complete combustion of a fuel gas/air mixture to produce an exothermic (exo) atmosphere. The exothermic-based atmosphere compositions may have the water vapor removed to produce a desired dew point in the furnace atmosphere.

The blended nitrogen atmospheres created by mixing gaseous nitrogen with an oxygenated hydrocarbon are a distinct improvement on the exo or endo processes. The oxygenated hydrocarbons do produce the preferred carbon monoxide and hydrogen species but most still contain a carbon to carbon bond and must be handled as liquids. Carbon to carbon bonds are known to readily dehydrogenate and polymerize at elevated temperatures which leads to the deposition of surface carbon, or more commonly, soot. Methanol does not have carbon to carbon bonds, but it is a liquid and although carbon monoxide and hydrogen are the primary products of its decomposition above about 1400° F. (760° C.), substantial quantities of carbon dioxide and water vapor are produced below this temperature. Both of these latter components can lead to excessive decarburization and/or oxidation of the surface of a metal being heated under such an atmosphere. The use of liquid hydrocarbon systems such as methanol necessitate the use of a vaporizer and/or injecting the liquid into the furnace where it is vaporized and then dissociated.

According to the present invention, dimethyl ether which can be stored as a gas under pressure in a conventional pressurized gas storage apparatus, can be mixed in a standard flow control panel for injection into a furnace.

The mixture can be used in furnaces which are held at temperatures of between 1200° F. (649° C.) and 1340° F. (727° C.) to perform subcritical annealing, e.g., annealing that is done below the lower transformation temperature of the metal, furnaces held at temperatures of from 1340° F. (727° C.) to about 1600° F. (871° C.) wherein critical annealing can be performed and furnces held at temperatures of between 1450° F. (788° C.) and 1650° F. (899° C.) wherein a neutral hardening can be performed.

A precise and consistent blend of dimethyl ether and nitogen is injected into the furnace where the dimethyl ether dissociates to produce an atmosphere consisting substantially of hydrogen, carbon monoxide, and methane. When the proper dimethyl ether concentration is determined an atmosphere will be produced which is reducing to the steel and neutral to dissolved carbon with this characteristic of the atmosphere being maintained, since it can not change as is wont to happen with generated atmospheres. Perhaps only minor alterations of the inlet blend would be necessary during the processing to maintain control that will be more reliable and prevent decarburizaton, recarburizing, sooting or oxidation of the material being treated.

The problems with sooting and tight control range when using nitrogen hydrocarbon systems are sharply diminished when using dimethyl ether nitrogen blend, since the dimethyl ether has no carbon to carbon bonds. Materials which have carbon to carbon bonds have been shown to more readily result in carbon polymerization (sooting). On the other hand, dimethyl ether produces high levels of carbon monoxide and hydrogen which are the preferred carbon control agents.

The major advantage that dimethyl ether holds ove hydrocarbons in the neutral atmospheres is that it has much lower tendency to soot than either propane or propylene, since it has no carbon to carbon bonds and breaks down more readily than methane at annealing or hardening temperatures (1200° F. to 1650° F.–650° C. to 900° C.). Dimethyl ether also produces primarily carbon monoxide and hydrogen which are the preferred species for carbon control in these systems. Methanol can also provide carbon monoxide and hydrogen, but it does so much less readily than dimethyl ether below temperatures of 1400° F. (760° C.). Furthermore, methanol also produces greater quantities of water vapor and carbon dioxide which are decarburizing and oxidizing agents than does dimethyl ether. In addition, it has been found that measuring the dew point (water content) in an atmosphere containing residual (undissociated) methanol is difficult. With mirror-type analytical devices the methanol will fog the mirror, whereas in dielectric systems the methanol effects the probe giving a false reading. Neither of these conditions exist with dimethyl ether so that there can be precise measurement of residual water vapor or dew point in a furnace wherein the dimethyl ether nitrogen blend is used.

Tests were run which show that at furnace temperatures of 1400° F. (760°) or above there is almost complete breakdown of the dimethyl ether resulting in no residual dimethyl ether in the furnace during the heating operation.

A series of tests were conducted on an AISI 1018 steel and an AISI 1045 steel annealed for three hours at 1275° F. (690° C.). The results of these tests are set forth in Table 1 below.

TABLE I

| Run | Inlet | | Furnace Atmosphere | | | | | Surface Condition |
|---|---|---|---|---|---|---|---|---|
| # | Steel | % DME | % $H_2$ | % CO | % $H_2O$ | % $CO_2$ | % $CH_4$ | Optically Measured |
| 1 | 1018 | 2.1 | 3.0 | 2.7 | 0.20 | 0.76 | 1.7 | 0.005" Surface Decarb (Partial) |
| | 1045 | 2.1 | 3.0 | 2.7 | 0.20 | 0.76 | 1.7 | Slight Surface Decarb (Partial) |
| 2 | 1018 | 4.3 | 7.2 | 5.0 | 0.062 | 0.47 | 4.70 | Neutral |
| | 1045 | 4.3 | 7.2 | 5.0 | 0.062 | 0.47 | 4.70 | Neutral |

From the foregoing table it can be seen that the 1018 and 1045 steels heated in an atmosphere containing 2.1% by volume dimethyl ether produced partial surface decarburization that ran from slight to approximately 0.005 inches in depth. Most heat treaters consider partial decarburization in an amount up to 0.010 inches in depth to be acceptable. The result of run #2 showed that at 4.3% by volume dimethyl ether there was no preceptable decarburization or recarburization under optical examination.

A further series of tests were run in a tube furnace wherein an AISI 1022 steel was heated to 1410° F. (766° C.) for a six hour period under varying atmospheres.

The results of these tests are set forth in Table II below.

TABLE II

| Run # | Input | Furnace Atmosphere % $H_2$ | % CO | % $CH_4$ | % $CO_2$ | % $H_2O$ | Decarb/Recarb (in)* | Soot |
|---|---|---|---|---|---|---|---|---|
| | % DME | | | | | | | |
| 1 | 0 | 0 | 0 | 0 | 0 | 0.0014 | −0.003 | None |
| 2 | 0** | 0 | 0 | 0 | 0 | 0.0760 | −0.008 | None |
| 3 | 0.1 | 0.18 | 0.15 | 0.1 | 0.010 | 0.0072 | −0.001 | None |
| 4 | 0.5 | 0.5 | 0.43 | 0.4 | 0.008 | 0.0080 | +0.005 | None |
| 5 | 1.0 | 1.0 | 0.95 | 0.9 | 0.006 | 0.0072 | +0.005 | Very Slight |
| 6 | 1.0** | 1.2 | 1.0 | 0.85 | 0.062 | 0.0840 | −0.013 | None |
| | % Propane | | | | | | | |
| 7 | 0.2 | 0.5 | 0.000 | 0.3 | 0.006 | 0.0100 | +0.010 | Moderate |
| 8 | 0.4 | 1.0 | 0.002 | 0.7 | 0.005 | 0.0100 | +0.010 | Heavy |

*(+) denotes carburizing (−) denotes decarburizing
**Small quantity of $H_2O$ added intentionally during these runs In the foregoing table run #1 was conducted without the addition of dimethyl ether in a 100% nitrogen atmosphere, run #2 was basically nitrogen to which was added water vapor, runs 3, 4 and 5 were conducted using dimethyl ether-nitrogen mixtures, run 6 was a dimethyl ether, water, nitrogen blended atmosphere, and runs 7 and 8 were propane nitrogen atmospheres. From the foregoing it is apparent that run #3 produced slight decarburization and no sooting, whereas runs #4 and #5 produced a very slight recarburization with very slight to no sooting. Run #1 also produced a low value of decarburization, however, a strong oxide coating was noticed on the samples which would explain the lack of decarburization. Of course, runs #2 and #6 show the effect of the added water which increases the rate of decarburizatin with sample #6 being totally unacceptable from a commercial standpoint. Runs 7 and 8 show that the use of a minor amount of hydrocarbon addition to the nitrogen not only produce greater recarburization, but also produces sooting to an unacceptable level thus demonstrating the difficulty in controlling the process when using a hydrocarbon addition.

A further series of tests were conducted using nitrogen, dimethyl ether atmospheres in a commercial furnace. The nitrogen dimethyl ether tests were compared with tests run using an atmosphere generated in an exothermic generator, in an atmosphere consisting of 100% nitrogen, and an atmosphere consisting of nitrogen to which is added 0.33% by volume propylene. The tests were conducted in a bell retort furnace with inside dimensions of 7 ft. in diameter ×7 ft. tall. The material used was AISI 1018 steel wire coils ⅛ to ¼ inch in diameter with stearate surface lubricants present. All steels were subject to a heating cycle which included a two hour purge of the furnace, one-half hour heat of the furnace at 900° F. (482° C.), three hold at 900° F. (482° C.), six hours to heat and hold at 1300° F. (704° C.), two hours to cool to 900° F. (482° C.) where upon the bell retort was removed to allow the material to cool in the air. The results of these tests are set forth in Table III below.

TABLE III

| | Atmosphere Source | Depth of Partial Decarb | Soot |
|---|---|---|---|
| #1 | Exo-4% $H_2$, 3.5% CO, 0.008% $H_2O$ bal. $N_2$ | Up to 0.015" | Moderate |
| #2 | 100% $N_2$ | >0.020" | None |
| #3 | $N_2$ + 0.33% Propylene ($C_3H_6$) | 0.0075"–0.010" | Moderate |
| #3A(1) | $N_2$ + 0.33% Propylene ($C_3H_6$) | 0.005"–0.007" | Moderate |
| #4(2) | $N_2$ + 2.5% DME ($CH_3OCH_3$) | 0–0.004" | Very Slight |

(1)Wire cleaned to remove lubricant prior to annealing.
(2)The furnace atmosphere was analyzed giving:
2.6% $H_2$
0.75% $CO_2$
3.0% CO
0.085% $H_2O$
2.1% $CH_4$ From the foregoing it is apparent that the nitrogen, dimethyl ether atmosphere produced the least amount of surface decarburization for the materials tested. The addition of propylene to the nitrogen resulted in a higher level of decarburization which was decreased somewhat in these tests by cleaning the material before annealing. The exothermic atmosphere produced unacceptable levels of decarburization.

A series of tests were run in a six inch wide belt furnace having a hearth length of twenty feet to compare annealing of ferrous metal articles under a nitrogen/dimethyl ether ($N_2$—DME) atmosphere in comparison to a nitrogen/methanol ($N_2$—MEOH) atmosphere. The samples used were as follows:

| | |
|---|---|
| AISI | 1018 bars ½" D × 6" 1 |
| AISI | 1045 bars ½" D × 6" 1 |
| AISI | 1022 wire ¼" D × 6" 1 |
| AISI | 1065 wire ¼" D × 6" 1 |

D denotes diameter of samples
1 denotes length of samples

All samples were placed into the furnace and subjected to a heating cycle of 0.5 hr. heating, 4-hour soak at temperature, and 1-hour cooling to room temperature. The results of the tests are set forth in Table IV.

TABLE IV

| INPUT DME (%) | INPUT MEOH (%) | FURNACE TEMP (°F.) | FURNACE ATMOSPHERE VOL % $H_2$ | CO | $CH_4$ | RESIDUAL $CO_2$ | $H_2O$ | DME | MEOH | DECARB/RECARB** (INCHES) 1018 | 1045 | 1022 | 1065 | CARBON SOOT |
|---|---|---|---|---|---|---|---|---|---|---|---|---|---|---|
| — | 1.5 | 1550 | 3.1 | 1.6 | 0.5 | 0.05 | 0.038 | — | 0 | 0 | −.001 | −.001 | 0 | Yes |
| 1.5 | — | 1550 | 2.6 | 1.6 | 1.6 | 0.02 | 0.002 | 0 | — | 0 | 0 | +.001 | 0 | No |
| — | 1.5 | 1400 | 1.9 | 1.1 | 1.3 | 0.07 | * | — | 0.4 | +.001 | −.001 | +.002 | 0 | Slight |
| 1.5 | — | 1400 | 2.1 | 1.6 | 1.6 | 0.04 | 0.002 | 0.07 | — | 0 | +.002 | +.002 | 0 | No |
| — | 1.5 | 1250 | 0.25 | 0.1 | 0 | 0.04 | * | — | 1.0 | 0 | +.003 | −.001 | 0 | Yes |

TABLE IV-continued

| INPUT | | FURNACE | | FURNACE ATMOSPHERE | | | | | | DECARB/RECARB** | | | | |
|---|---|---|---|---|---|---|---|---|---|---|---|---|---|---|
| | | | | VOL % | | RESIDUAL | | | | (INCHES) | | | | CARBON |
| DME | MEOH | TEMP | | | | | | | | | | | | |
| (%) | | (°F.) | $H_2$ | CO | $CH_4$ | $CO_2$ | $H_2O$ | DME | MEOH | 1018 | 1045 | 1022 | 1065 | SOOT |
| 1.5 | — | 1250 | 0.35 | 0.5 | 0.5 | 0.03 | 0.002 | 1.0 | — | 0 | 0 | 0 | 0 | No |

*Dew Point was not measurable due to uncracked MeOH in sample
**(−) decarb
(+) recarb
0 neutral The test results set forth in Table IV demonstrate that dimethyl ether outperformed methanol as a carbon control additive in a nitrogen based annealing atmosphere in the temperature range tested. The results for decarb/recarb are more consistent with dimethyl ether than with methanol; i.e., the surface of the steel samples run in dimethyl ether showed a more uniform carbon content than those run in methanol.

There is also an improvement in the sooting characteristics of dimethyl ether over methanol-treated samples. All samples run with dimethyl ether were very clean when exiting the furnace, while parts run with methanol were covered with carbon soot.

Methanol performed better in the laboratory furnace than it would in a production situation and it still did not perform as well as dimethyl ether. The lab belt furnace is muffle lined, clean, and very dry with a low $O_2$ content (i.e., 4 ppm $O_2$). This would help to improve the performance using methanol. However, in production situation, factors such as high levels of oxides on the steel, air infiltration and high water levels in the furnace would act to deteriorate the carbon controlling characteristics of methanol.

The process of the invention utilizing a dimethyl ether nitrogen atmosphere blend injected into a furnace used to heat ferrous metal articles for annealing or hardening eliminates the inconsistency of generated atmospheres and furthermore provides the advantage of enabling the use of a standard flow control panel to blend the dimethyl ether at the appropriate level with the nitrogen before injection into the furnace. Furthermore, the storage requirements for dimethyl ether are much less stringent than those for methanol.

As set out above, the process of the present invention minimizes decarburization, eliminates recarburizing, sooting and oxidation of parts being heated to thus achieve a better part after annealing and/or hardening.

Having thus described our invention, what is desired to be secured by Letters Patent of United States is set out in the appended claims.

What is claimed:

1. In the heating of ferous metal articles at elevated temperatures under a controlled furnace atmosphere a heat treatment selected from the group of annealing, subcritical annealing, and hardening in which the improvement comprises heating said ferrous metal article under an atmosphere prepared by forming a mixture of from 0.1 to about 5% by volume dimethyl ether, balance nitrogen and introducing said mixture into said furnace to reduce, decarburization and recarburization of the surface of said articles.

2. A method according to claim 1 wherein the heating is for the purpose of annealing said articles and said furnace is maintained at a temperature of between 1340° F. (727° C.) and 1600° F. (871° C.).

3. A method according to claim 1 wherein the heating is for the purpose of subcritical annealing and said furnace is maintained at a temperature of between 1200° F. (788° C.) and 1340° F. (727° C.).

4. A method according to claim 1 wherein the heating is for the purpose of hardening and said furnace is maintained at a temperature of between 1450° F. (788° C.) and 1650° F. (899° C.).

5. A method according to claim 1 wherein said dimethyl ether is present in the mixture in an amount of from 0.1% to 4.3% by volume.

* * * * *